US012291418B2

(12) United States Patent
Ikeda et al.

(10) Patent No.: US 12,291,418 B2
(45) Date of Patent: May 6, 2025

(54) SHEET FEEDING APPARATUS AND RECORDING APPARATUS

(71) Applicant: CANON KABUSHIKI KAISHA, Tokyo (JP)

(72) Inventors: Yuki Ikeda, Kanagawa (JP); Hikaru Watanabe, Tokyo (JP); Ryo Harigae, Tokyo (JP); Tomohiro Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 203 days.

(21) Appl. No.: 18/062,470

(22) Filed: Dec. 6, 2022

(65) Prior Publication Data

US 2023/0202783 A1 Jun. 29, 2023

(30) Foreign Application Priority Data

Dec. 24, 2021 (JP) ..... 2021-211159

(51) Int. Cl.
*B65H 19/12* (2006.01)
*B65H 5/06* (2006.01)
*B65H 16/10* (2006.01)

(52) U.S. Cl.
CPC ..... *B65H 5/06* (2013.01); *B65H 19/12* (2013.01)

(58) Field of Classification Search
CPC ..... B65H 19/12; B65H 16/103; B65H 16/06; B65H 2301/41342; B65H 2301/41366; B65H 2801/12; B65H 5/06; B41J 15/046; B41J 15/042
See application file for complete search history.

(56) References Cited

U.S. PATENT DOCUMENTS

2010/0239349 A1* 9/2010 Sakurai ..... B65H 23/32 271/11
2011/0076083 A1* 3/2011 Tsurui ..... B65H 19/126 226/152
2021/0237998 A1* 8/2021 Kobayashi ..... B65H 20/02

FOREIGN PATENT DOCUMENTS

JP 2018171733 A 11/2018

* cited by examiner

*Primary Examiner* — Luis A Gonzalez
(74) *Attorney, Agent, or Firm* — Canon U.S.A., Inc. I.P. Division

(57) ABSTRACT

A sheet feeding apparatus includes a support portion, a guide portion, and a contact unit. The support portion rotatably supports a roll having a sheet wound to the roll. In loading the roll, the guide portion guides the roll in a guide direction from above the support portion to the support portion. The contact unit contacts an outer periphery of the roll supported by the support portion. The contact unit contacts the roll from upstream in the guide direction, and, in feeding the sheet, the sheet is fed from the roll supported by the support portion.

14 Claims, 14 Drawing Sheets

SHEET FEEDING APPARATUS AND RECORDING APPARATUS

BACKGROUND

Field

The present disclosure relates to a sheet feeding apparatus and a recording apparatus that feed a sheet from a roll.

Description of the Related Art

Sheet feeding apparatuses for feeding a sheet from a wound roll of a sheet desirably prevent the roll from moving from the loaded position during sheet feeding. Japanese Patent Application Laid-Open No. 2018-171733 discusses a recording apparatus including a support portion that detachably supports a roll, a guide portion that guides the roll to the support portion, and a movement blocking unit that blocks the movement of the rotation shaft of the roll. This recording apparatus is configured to prevent the roll from moving from the support portion by the movement blocking unit protruding into the guide path of the guide portion.

SUMMARY

According to an aspect of the present disclosure, a sheet feeding apparatus includes a support portion configured to rotatably support a roll having a sheet wound to the roll, a guide portion configured to, in loading the roll, guide the roll in a guide direction from above the support portion to the support portion, and a contact unit configured to contact an outer periphery of the roll supported by the support portion, wherein the contact unit is configured to contact the roll from upstream in the guide direction, and, in feeding the sheet, the sheet is fed from the roll supported by the support portion.

Further features of the present disclosure will become apparent from the following description of exemplary embodiments with reference to the attached drawings.

DESCRIPTION OF THE EMBODIMENTS

Figure 1:
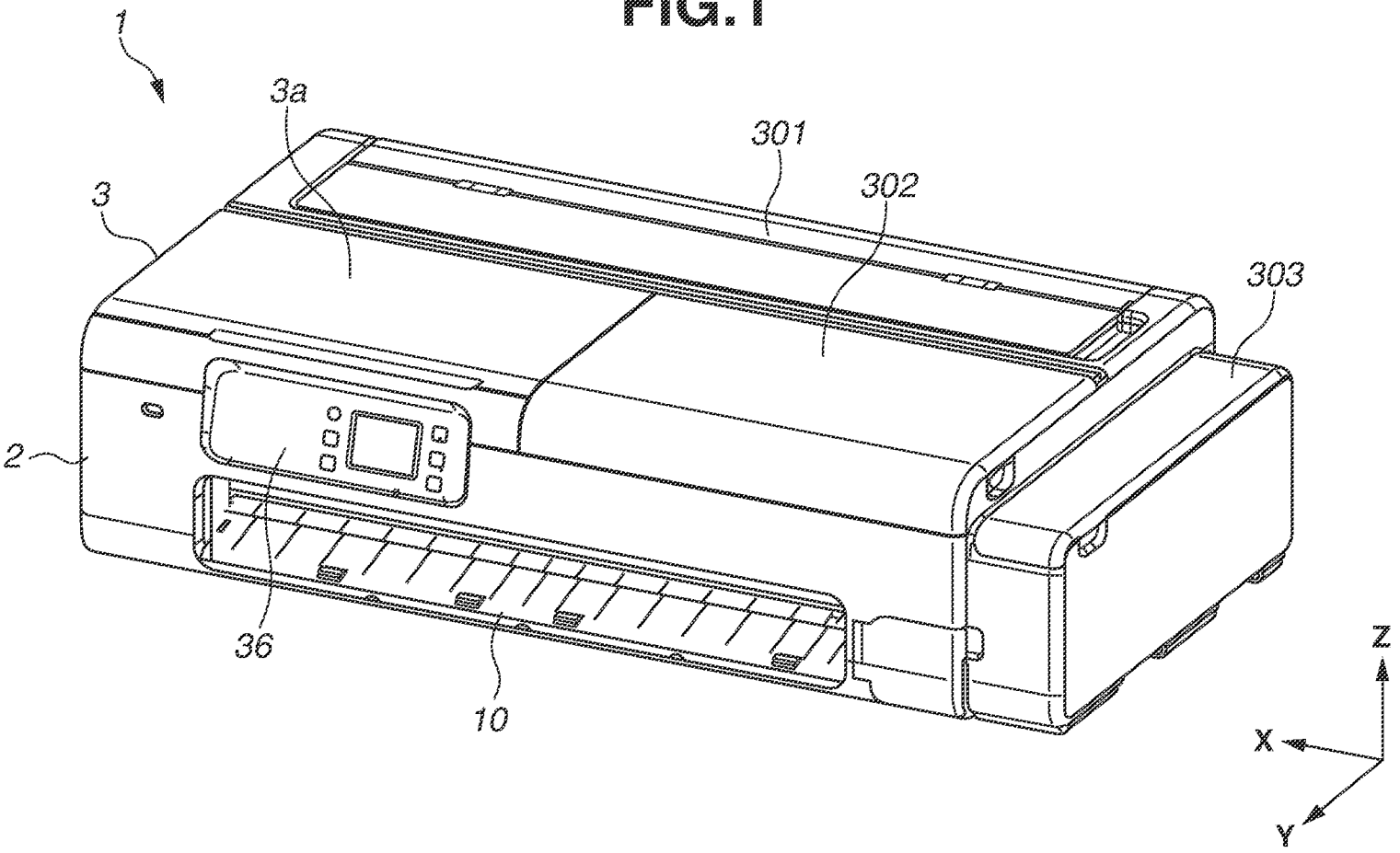
FIG. 1 is a perspective view illustrating an entire recording apparatus.

An exemplary embodiment will be described below with reference to the drawings. The following exemplary embodiment is not intended to limit the disclosure set forth in the claims. While the exemplary embodiment describes more than one feature, all the features are not necessarily indispensable to the disclosure, and some of the features may be freely combined. In the drawings, the same or similar components are denoted by the same reference numerals. A redundant description thereof may be omitted.

In the exemplary embodiment, recording is not limited to the case of forming significant information such as characters and figures, but also covers the case of forming an image or a pattern on a sheet. While in the exemplary embodiment the sheet is assumed to be a sheet of paper, other sheets such as fabric and a plastic film may be used. The present exemplary embodiment is also applicable to electrophotographic recording apparatuses in addition to inkjet recording apparatuses.

<Recording Apparatus>

FIG. 1 is a perspective view illustrating an entire recording apparatus. A recording apparatus 1 is an inkjet recording apparatus that discharges liquid ink to record on a sheet. In the drawings, arrows X and Y indicate mutually orthogonal horizontal directions. An arrow Z indicates a vertical direction. The X direction is a width direction of a loaded roll. The Y direction is a direction from the rear to the front of the recording apparatus 1.

The recording apparatus 1 has a flat rectangular solid shape as a whole, and includes a main body unit 2 accommodating principle components, and a cover unit 3 including a plurality of covers. The cover unit 3 is located over the main body unit 2, and includes a feed cover 301 for covering the roll, an access cover 302 for doing maintenance inside the recording apparatus 1, and a tank access cover 303 for covering tanks of the recording apparatus 1. The recording apparatus 1 includes a reading device (scanner unit) 3*a* that reads a document image. Like the access cover 302, the entire reading device 3*a* can also be rotated to do maintenance inside the recording apparatus 1. The feed cover 301 and the reading device 3*a* are arranged in the Y direction from the rear to the front, the direction in which the recording apparatus 1 feeds the sheet.

A discharge unit 10 for discharging an image-recorded sheet is located at the front of the recording apparatus 1. An operation unit 36 for accepting user operations is located at the front of the recording apparatus 1 above the discharge unit 10. The operation unit 36 includes a touchscreen display unit, and accepts the user's input operations and displays various types of information to the user.

Figure 2:
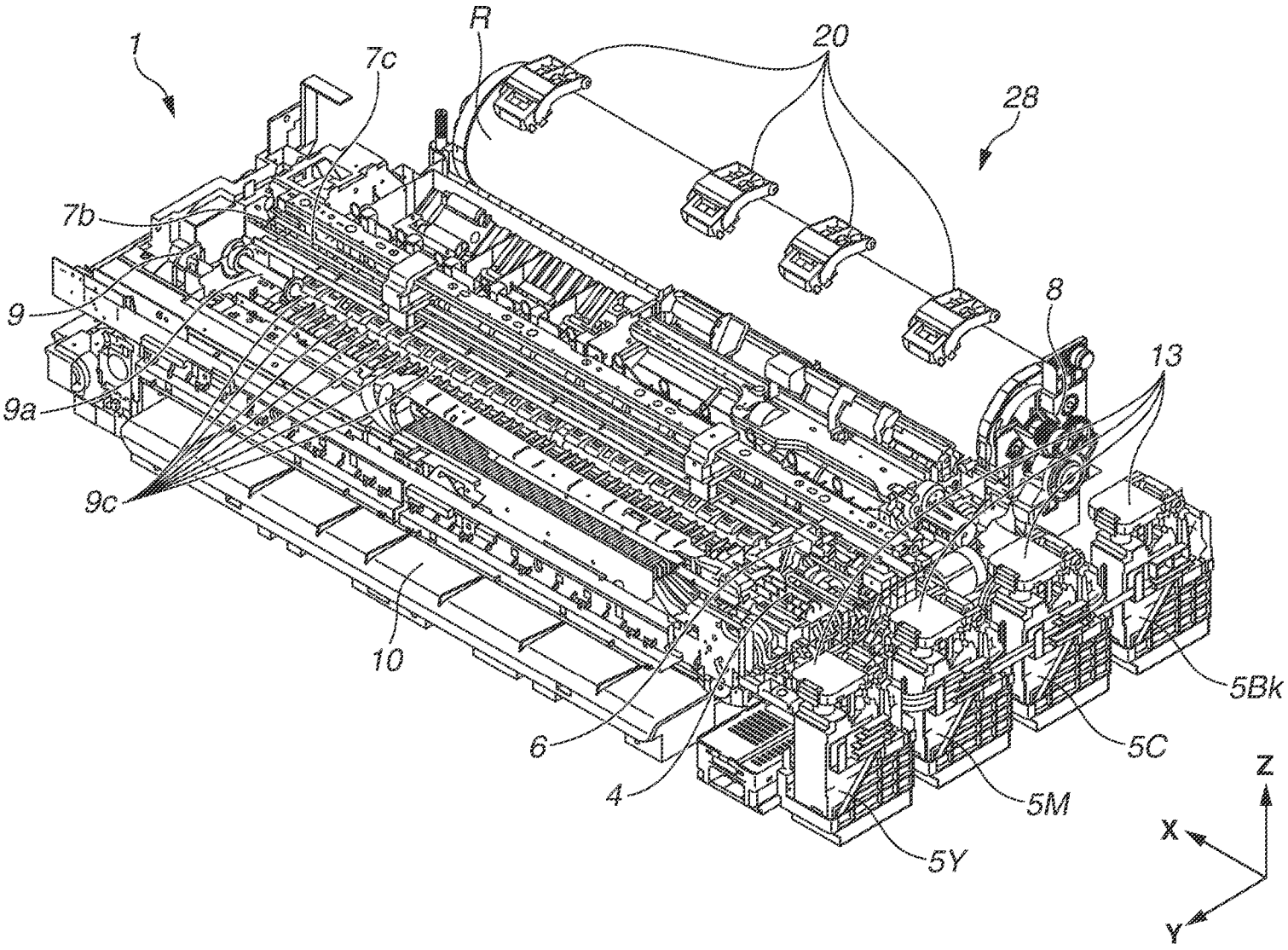
FIG. 2 is a diagram illustrating an internal configuration of the recording apparatus.

FIG. 2 is a diagram illustrating an internal configuration of the recording apparatus 1. The recording apparatus 1 includes a recording head 4 that discharges liquid ink. The recording head 4 performs recording by discharging inks supplied from ink-accommodating containers 5 (Y: yellow, M: magenta, C: cyan, and Bk: black) to a sheet. The recording head 4 has a discharge surface where a plurality of nozzles for discharging ink is formed. Each nozzle includes an electrothermal transducer element (heater), and can discharge ink by heating when energized. The nozzles may include piezo elements instead.

The recording head 4 is mounted on a carriage 6 and reciprocated in the X direction by a driving unit. The driving unit includes a driving pulley and a driven pulley 7*b* located at a distance in the X direction, an endless belt 7*c* wound around the pulleys, and a carriage motor 7*a* (FIG. 5) that is a driving unit for rotating the driving pulley. The carriage 6 is coupled to the endless belt 7*c*. Moving the endless belt 7*c* by the carriage motor 7*a* can reciprocate the carriage 6 in the X direction. An image is recorded on the sheet by a discharge operation to discharge the inks from the recording head 4 to the sheet while the carriage 6 is moving. The recording apparatus 1 is a serial inkjet recording apparatus where the recording head 4 is mounted on the reciprocating carriage 6. Note that the present exemplary embodiment can also be applied to an inkjet recording apparatus including a full-line recording head where a plurality of nozzles for discharging ink is provided throughout the area corresponding to a full sheet width.

Figure 3A:
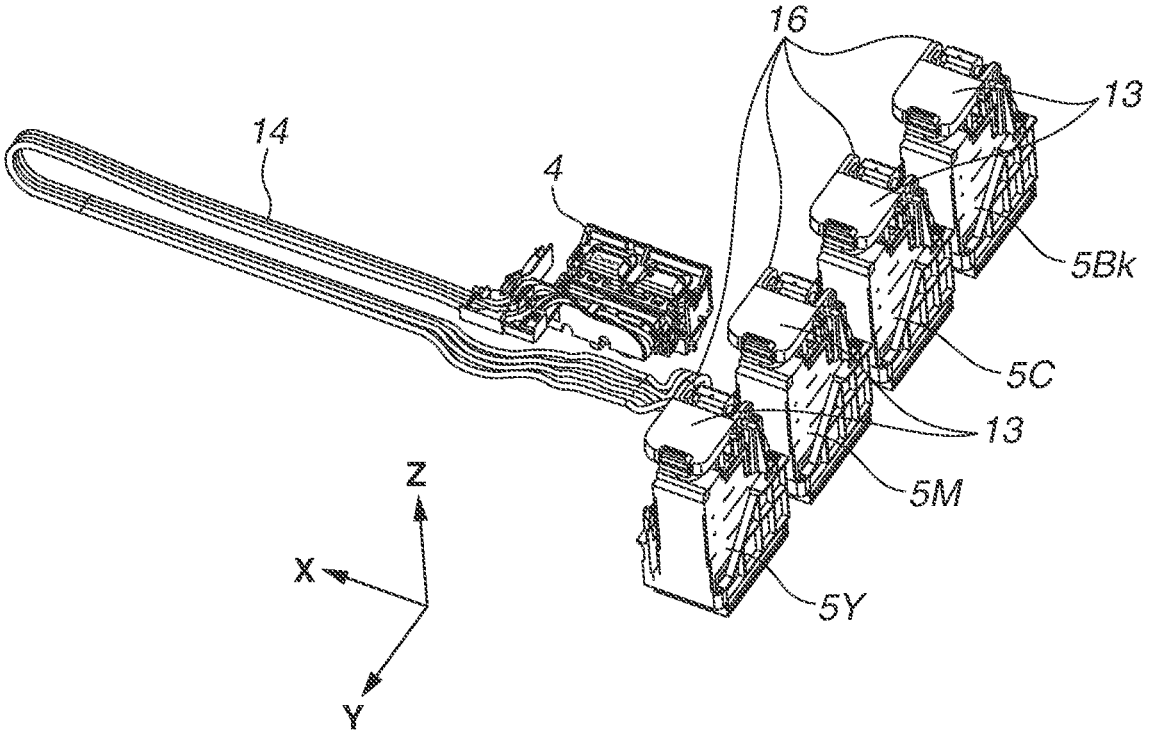
FIGS. 3A and 3B are diagrams illustrating a configuration of containers accommodating ink.
Figure 3B:
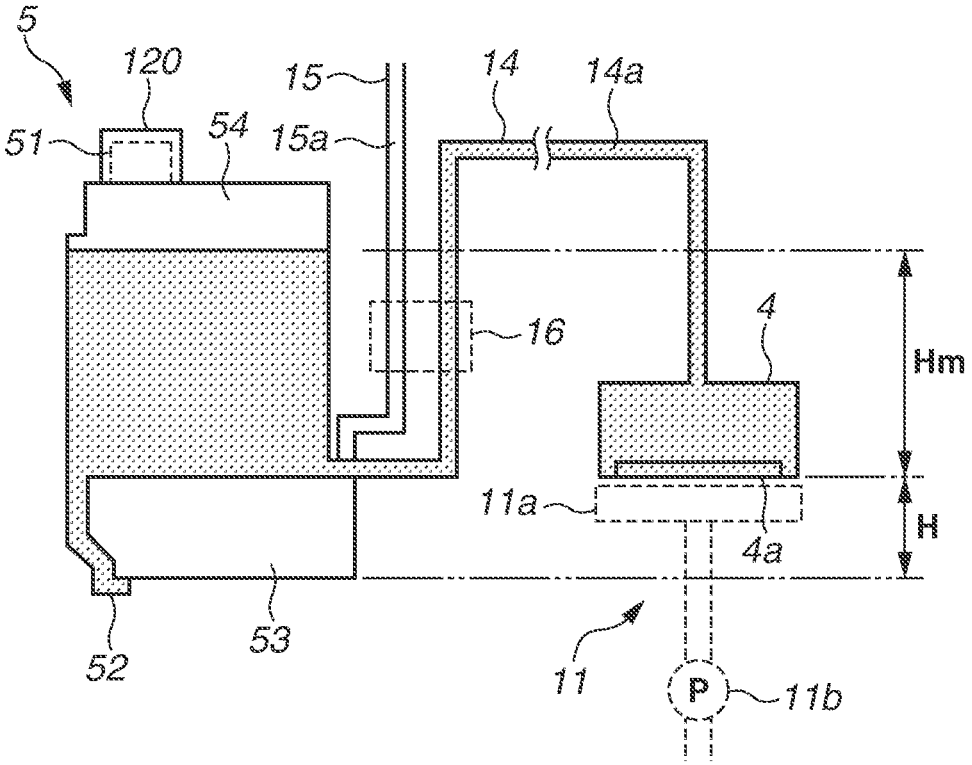

FIGS. 3A and 3B are diagrams illustrating a configuration of the containers 5 accommodating ink. FIG. 3A is a perspective view illustrating the containers 5 for the respective color inks and the recording head 4. Each container 5 is connected to the recording head 4 by a corresponding supply tube 14. FIG. 3B is a schematic diagram illustrating a structure of a container 5. The container 5 includes an accommodation portion 54 accommodating ink, a liquid-gas exchange portion 52, and a buffer chamber 53. The buffer chamber 53 can accommodate ink pushed out of the accommodation portion 54. An injection portion 51 for replenishing ink is located at the top of the container 5. The injection portion 51 is closed by a cap unit 120. When replenishing the ink, the user removes the cap unit 120 from the injection portion 51 and performs an ink replenishment operation. Cap units 120 are provided for the containers 5 of the respective colors.

The container 5 communicates with a channel 14*a* and a channel 15*a*. The channel 14*a* is an ink supply channel for supplying the ink from the accommodation portion 54 of the container 5 to the recording head 4. The channel 14*a* is formed of a supply tube 14 which is a flexible tube. The channel 15*a* is an air communication channel for making the buffer chamber 53 of the container 5 communicate with the air. The channel 15*a* is formed of an air communication tube 15 which is a flexible tube. A valve 16 opens and closes the channels 14*a* and 15*a*.

The liquid-gas exchange portion 52 is located a height H below a discharge surface 4*a* of the recording head 4, and can apply a negative pressure resulting from a head difference corresponding to the height H to the discharge surface 4*a*. During a recording operation, both the channels 14*a* and 15*a* are opened to supply the ink to the recording head 4. On the other hand, in replenishing the container 5 with ink, both the channels 14*a* and 15*a* are closed. The valve 16 opens and closes in an interlocking manner with the movement of the tank access cover 303 and a tank cover unit 13.

A recovery unit 11 is a mechanism for maintaining ink discharge performance of the recording head 4. The recovery unit 11 is located at an end of the moving range of the carriage 6. The recovery unit 11 includes a cap 11*a* for covering the discharge surface 4*a* of the recording head 4, and a pump 11*b* for sucking ink from the recording head 4 via the cap 11*a*. The cap 11*a* can be moved to a position to cover the discharge surface 4*a* and a position away from the discharge surface 4*a* by a not-illustrated mechanism. The recording head 4 can be prevented from drying by covering the discharge surface 4*a* with the cap 11*a* (capping).

Moreover, thickened ink adhering to the recording head 4 can be removed and the channel 14*a* and the recording head 4 can be filled with ink by activating the pump 11*b* with the discharge surface 4*a* capped with the cap 11*a*. If a recording operation is performed with the channel 14*a* and the recording head 4 filled with the ink, as much ink as discharged from the recording head 4 is supplied from the container 5.

Figure 4:
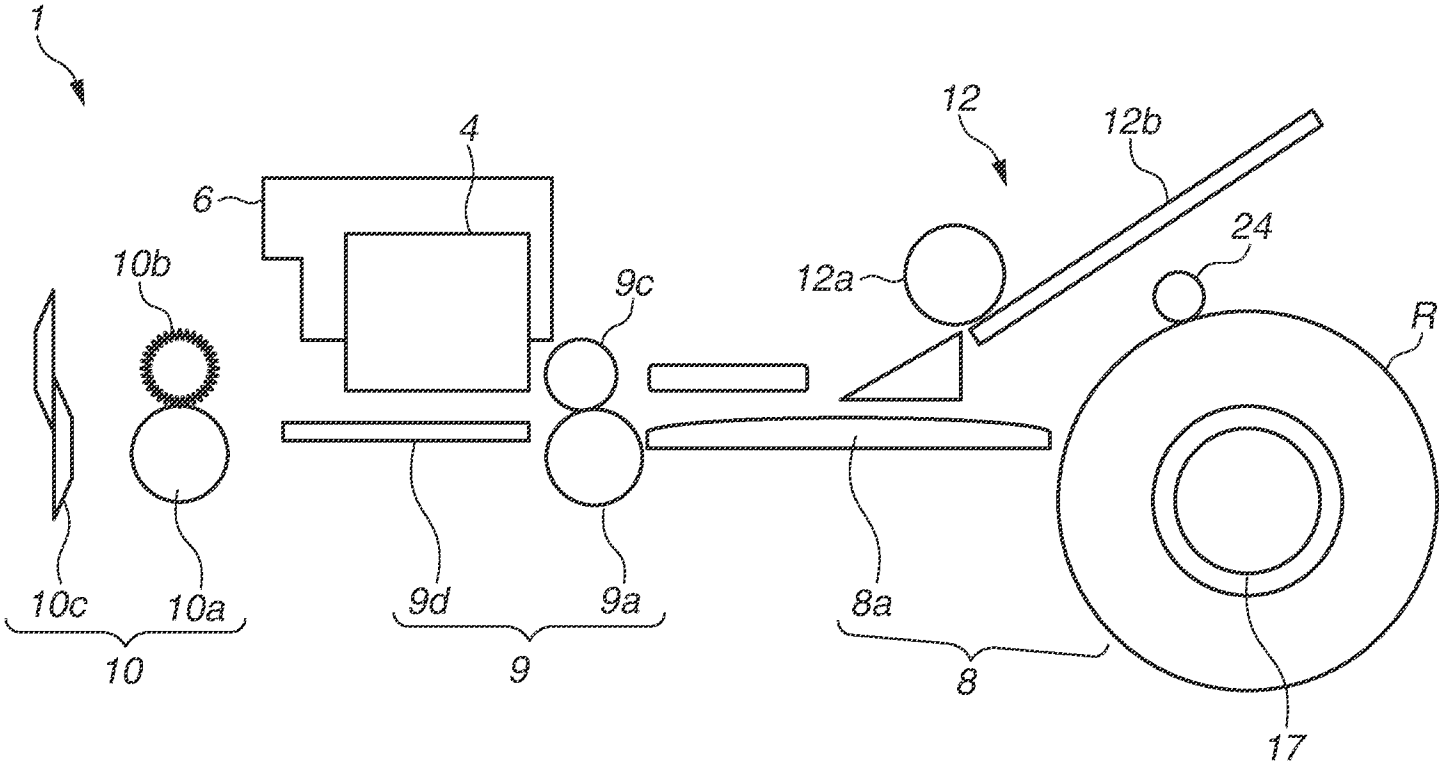
FIG. 4 is a schematic diagram illustrating principle components of the recording apparatus.

FIG. 4 is a schematic diagram illustrating principle components of the recording apparatus 1. The recording apparatus 1 includes a feed unit 8, a conveyance unit 9, the carriage 6, and the discharge unit 10. The feed unit 8 feeds a long continuous sheet S from the wound roll R of the sheet S. The feed unit 8 includes a roll setting unit 28 (FIG. 2) and a guide 8*a* for guiding the sheet S supplied from the roll setting unit 28 to the conveyance unit 9. The roll setting unit 28 includes nip roller units 20 and a feed motor 8*b* (FIG. 5) that is a part of a driving unit for driving the roll R to rotate.

The conveyance unit 9 conveys the sheet S fed from the feed unit 8 in a conveyance direction (Y direction). The conveyance unit 9 includes a conveyance roller 9*a* and a conveyance motor 9*b* (FIG. 5) which is a part of a driving unit for rotating the conveyance roller 9*a*. A pinch roller 9*c* is pressed against the conveyance roller 9*a* to form a nip portion. The sheet S is nipped at the nip portion and conveyed to a platen 9*d* by the rotation of the conveyance roller 9*a*. A recording operation for recording an image on the sheet S is performed by alternately repeating the conveyance operation of the sheet S by the conveyance unit 9 and the discharge operation where the recording head 4 discharges ink while moving in a scan direction (X direction). The discharge unit 10 includes a discharge roller 10*a*, spurs 10*b*, and a cutter 10*c*. The sheet S on which an image is recorded by the recording head 4 is conveyed to the cutter 10*c* by the discharge roller 10*a* and the spurs 10*b*.

The conveyed sheet S is cut by the cutter 10*c* and discharged from the recording apparatus 1. The recording apparatus 1 includes a second feed unit 12 that feeds a cut sheet placed on a tray 12*b* using a feed roller 12*a*. The cut sheet placed on the tray 12*b* is conveyed to the recording head 4 for image recording. In the case of recording an image on the cut sheet, the cutter 10*c* does not cut the cut sheet.

Figure 5:
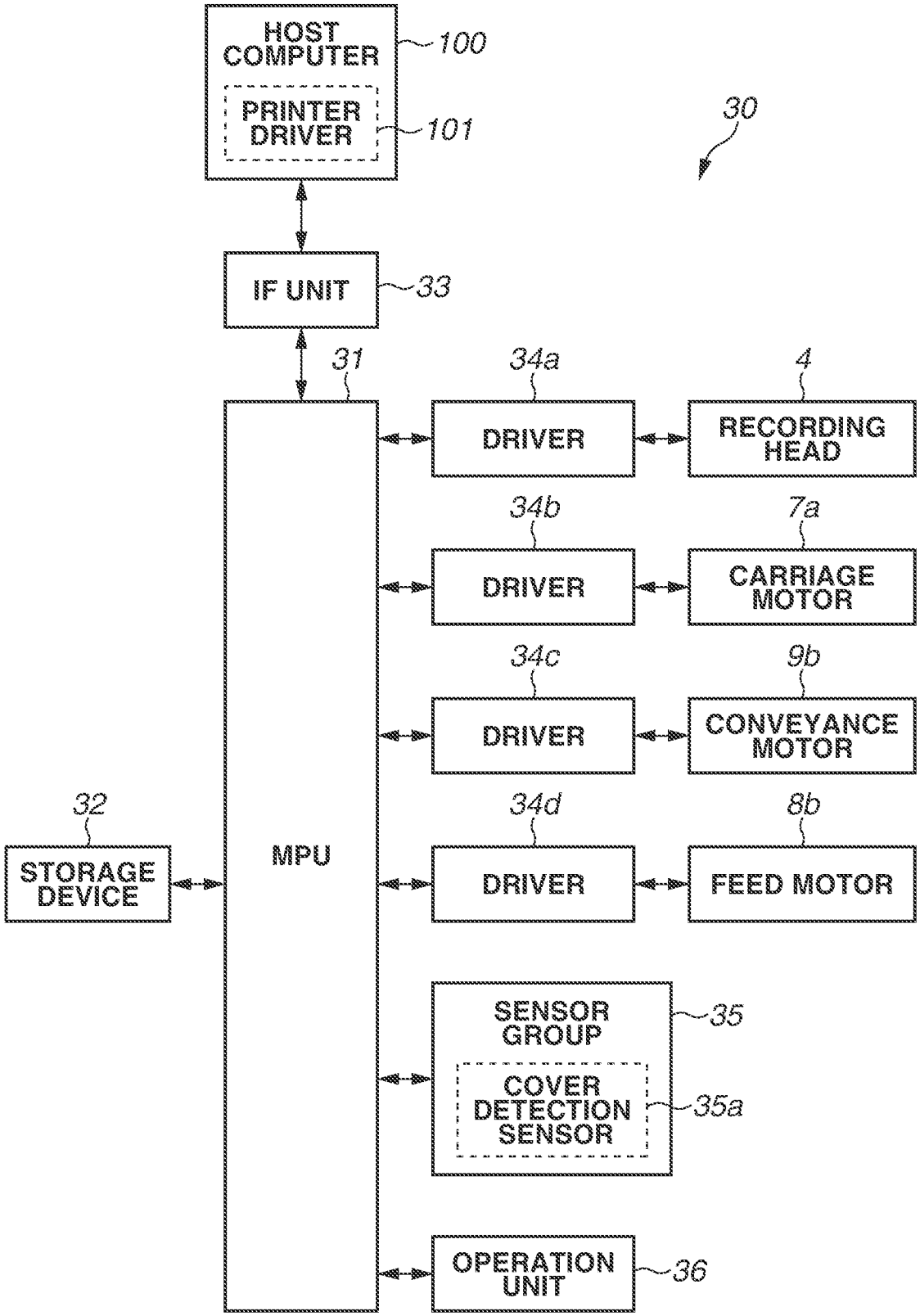
FIG. 5 is a block diagram illustrating a control-related configuration of the recording apparatus.

FIG. 5 is a block diagram illustrating a control-related configuration of the recording apparatus 1. A control unit 30 includes a microprocessing unit (MPU) 31, various drivers 34, a storage device 32, and an interface (IF) unit 33. The MPU 31 is a processor for controlling various operations and data processing of the recording apparatus 1. The MPU 31 controls the recording apparatus 1 by executing programs stored in the storage device 32. The storage device 32 includes a read-only memory (ROM) and a random access memory (RAM). In addition to the programs for the MPU 31 to execute, the storage device 32 can store data received from a host computer 100 and various types of data to be used in processing.

The MPU 31 performs a discharge operation by controlling the recording head 4 via a driver 34*a* and the carriage motor 7*a* via a driver 34*b*. The MPU 31 also performs a conveyance operation by controlling the conveyance motor 9*b* via a driver 34*c* and the feed motor 8*b* via a driver 34*d*. The MPU 31 obtains detection results of a sensor group 35 including various sensors in the recording apparatus 1, and performs various types of control. The sensor group 35 includes a cover detection sensor 35*a*.

The MPU 31 further performs display control on the display unit of the operation unit 36, and accepts user operations on the operation unit 36.

The host computer 100 is a personal computer or a mobile terminal (such as a smartphone and a tablet terminal), for example. A printer driver 101 for performing communication between the host computer 100 and the recording apparatus 1 is installed on the host computer 100. The recording apparatus 1 includes the IF unit 33 that serves as an IF for communicating with the host computer 100. If the user requests the host computer 100 to perform a recording operation, the printer driver 101 obtains image data and settings about the quality of the image to be recorded, and issues various instructions to the recording apparatus 1.

<Overview of Roll Setting Unit>

Figure 6:
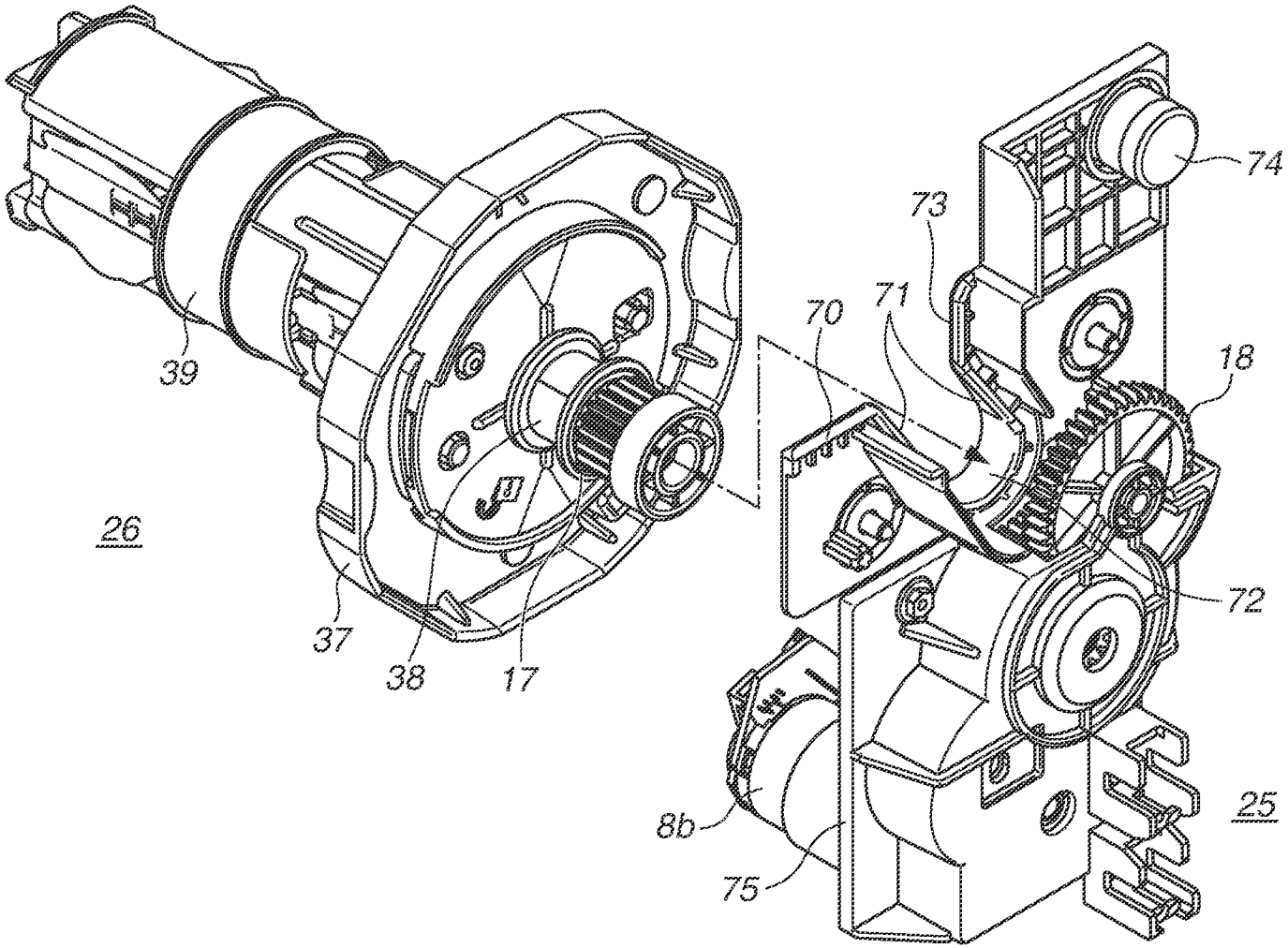
FIG. 6 is a perspective view illustrating a configuration of a spool unit and a support unit.
Figure 7:
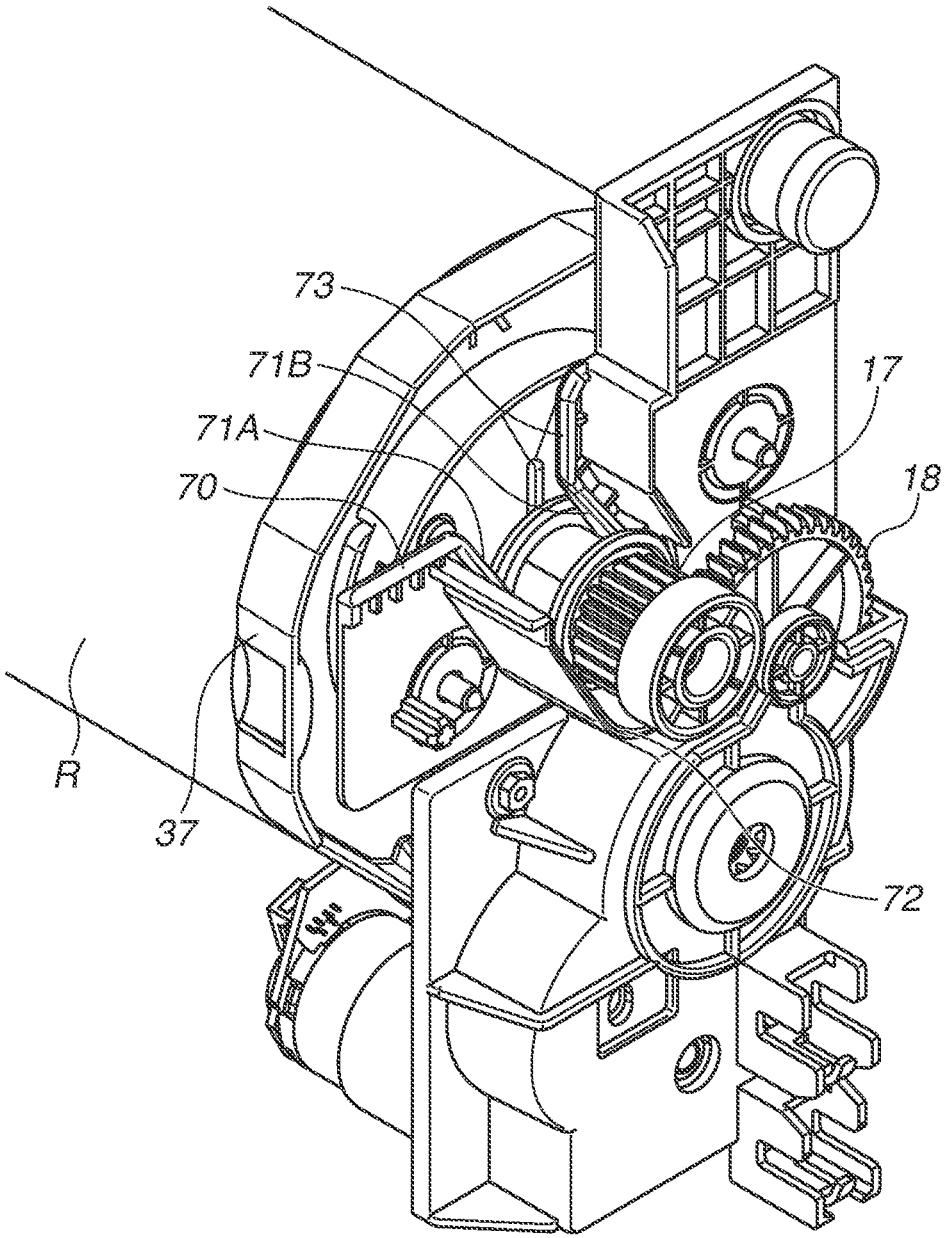
FIG. 7 is a perspective view illustrating a state where the spool unit is attached to the support unit.
Figure 8A:
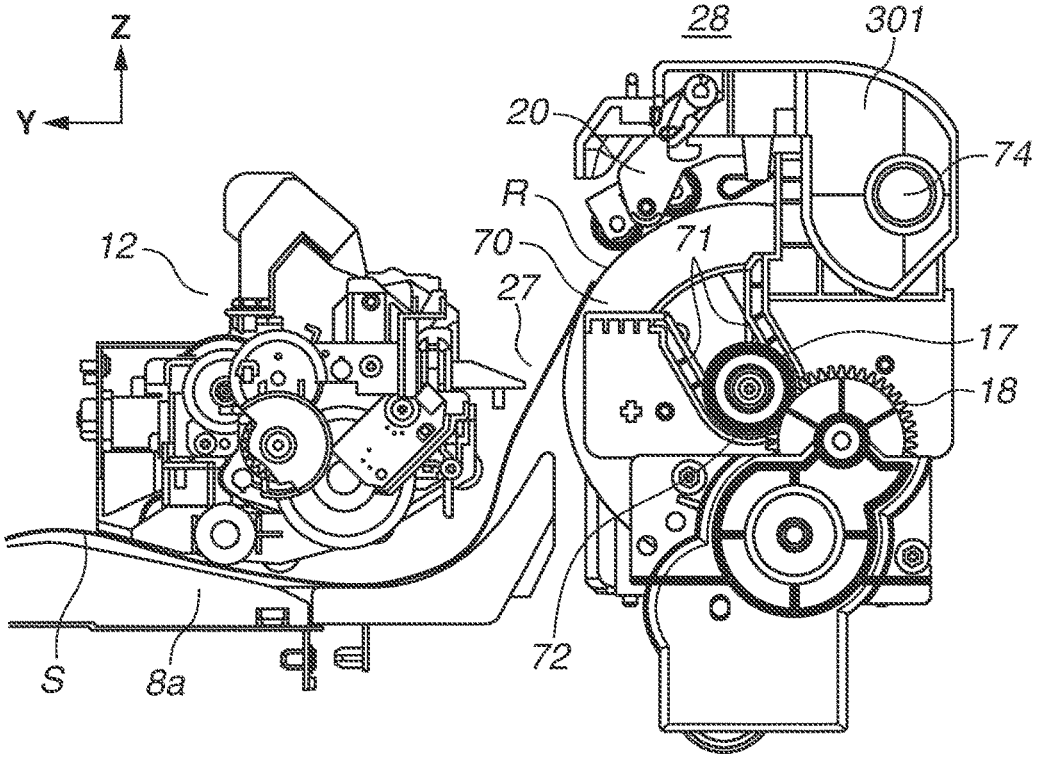
FIGS. 8A and 8B are sectional views of a roll setting unit.
Figure 8B:
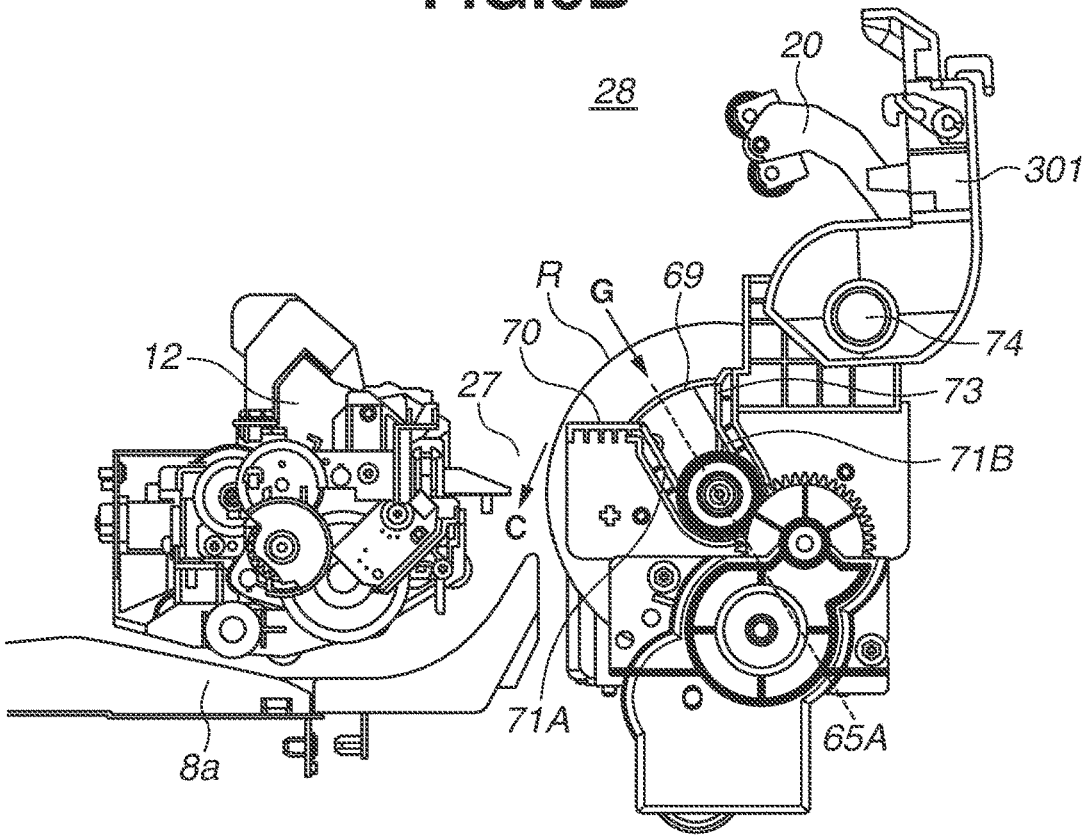
Figure 9:
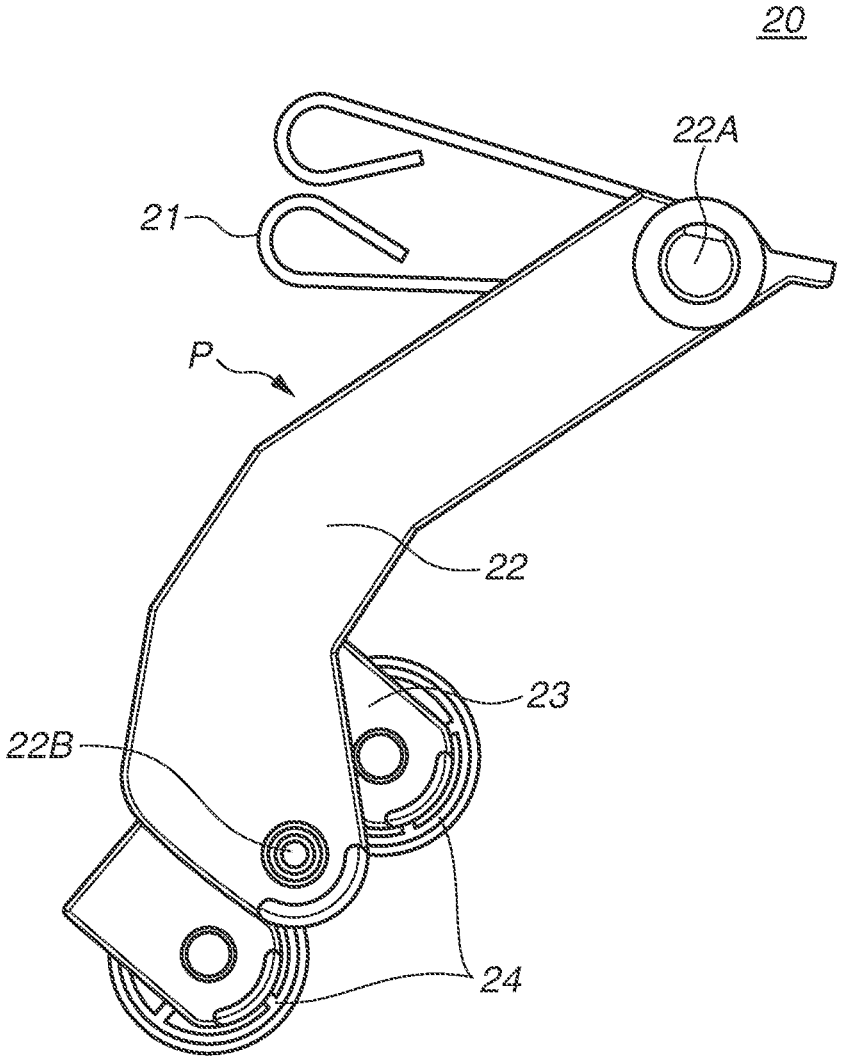
FIG. 9 is a side view illustrating a configuration of a nip roller unit.

The roll setting unit 28 will now be described with reference to FIGS. 6 to 9. In the present exemplary embodiment, the roll setting unit 28 is a sheet feeding apparatus. The roll setting unit 28 is located on the rear side of the recording apparatus 1, and includes support units 25 and the feed cover 301. The roll R is loaded on the roll setting unit 28 with spool units 26 attached thereto. The sheet feeding apparatus may include the roll setting unit 28 and the conveyance unit 9. FIG. 6 is a perspective view illustrating a configuration of a spool unit 26 and a support unit 25. FIG. 7 is a perspective view illustrating a state where the spool unit 26 is attached to the support unit 25. FIGS. 8A and 8B are sectional views of the roll setting unit 28. FIG. 9 is a sectional view illustrating a configuration of a nip roller unit 20.

To support the roll R with the support units 25, the spool units 26 are inserted into the ends of the roll R. Each spool unit 26 includes a spool gear 17, a flange 37, a spool shaft 38, and an insertion portion 39. The roll setting unit 28 includes the support units 25 that rotatably support the spool units 26, and the feed cover 301 that covers the roll R. Each support unit 25 includes a flange guide 75, a drive gear 18, guide portions 71, and a support portion 72. The spool unit 26 is rotatably supported by the support portion 72. The spool unit 26 is prevented from moving in the axial direction of the spool shaft 38 by a movement restriction portion. The feed cover 301 protects the roll R from the adhesion of dust, and prevents the user from touching the roll R during a recording operation. The feed cover 301 has an arc-shaped cross section throughout the width direction of the roll R, and can cover the outer periphery of the roll R with the inner side of the arc shape. The feed cover 301 is openably and closably supported by rotation shafts 74 of the support units 25 at both ends in the width direction of the roll R. The rotation shafts 74 are located above and behind the guide portions 71. The feed cover 301 can thus rotate between an open position (FIG. 8B) to not interfere with the locus of movement of the roll R and a closed position (FIG. 8A) to cover the roll R. The feed cover 301 includes a lock mechanism and can thus maintain the closed position. Note that the lock mechanism is not indispensable, and the feed cover 301 may be configured to maintain the closed position by its own weight.

Either one of the support units 25 includes a driving unit for driving the roll R. The driving unit includes the feed motor 8*b* and the drive gear 18. Counterclockwise rotation of the spool gear 17 (FIG. 10) feeds out the sheet S from the roll R. Clockwise rotation of the spool gear 17 winds the fed sheet S back to the roll R. The flange guide 75 is provided with the driving unit, the guide portions 71, and the rotation shaft 74, and fixed to the rear side of the main body unit 2. The flange guide 75 includes a setting table 70 where the roll R is placed in loading the roll R, and a restraining portion 73 that restrains the movement of the roll R. The roll R reaches the support portion 72 via the guide portions 71 sloping in a guide direction G from an opening 69 between the setting table 70 and the restraining portion 73. In other words, the opening 69 is located upstream in the guide direction G, and the support portion 72 downstream. The guide portions 71 include a vertically lower guide portion 71A and upper guide portion 71B. The guide portion 71A is connected to the setting table 70, and the guide portion 71B is connected to the restraining portion 73. The guide portion 71A is longer than the guide portion 71B. The upper end of the guide portion 71A is thus located above the upper end of the guide portion 71B.

The plurality of nip roller units 20 is disposed on the arc-shaped inner surface of the feed cover 301. Each nip roller unit 20 includes a torsion coil spring 21, an arm unit 22, a roller holding unit 23, and nip rollers 24. One end 22A of the arm unit 22 is rotatably held on the feed cover 301 at the inner side of the feed cover 301. The roller holding unit 23 is rotatably held by the arm unit 22 at the other end 22B of the arm unit 22. The roller holding unit 23 is configured so that its rotatable angle is greater than or equal to an angle desirable to make contact with rolls R within the range of minimum and maximum outer diameters. The nip rollers 24 thus correspond to a contact unit according to the present exemplary embodiment. Two nip rollers 24 are rotatably held at the respective ends of the roller holding unit 23. The torsion coil spring 21 is disposed at the junction of the end 22A of the arm unit 22 and the feed cover 301. The arm unit 22 can thus bias the nip rollers 24 in a direction P toward the axial center of the roll R. Since the nip rollers 24 are located upstream of the sloping guide portion 72 and the roll R has a cylindrical shape, a large space for accommodating the nip roller units 20 is not needed.

When the roll R to which the spool units 26 are attached is loaded on the recording apparatus 1 and the feed cover 301 is rotated to the closed position, the outer periphery of the roll R first contacts the nip rollers 24. The two nip rollers 24 at the end 22B of the arm unit 22 each rotate to an angle to make contact with the outer periphery of the roll R. Meanwhile, the nip rollers 24 are pressed by the reaction force from the roll R. As a result, the roll R is nipped by the nip rollers 24 with the spring force from the torsion coil spring 21 at the end 22A. In other words, the nip rollers 24 press the roll R toward the support portion 72 from upstream in the guide direction G. With the roll R loaded on the support units 25, the positions and angles of the nip rollers 24 change with the outer diameter of the roll R. The sheet S is fed through a feed port 27 between the feed unit 12 and the roll setting unit 28. The roll setting unit 28 is thus configured so that the tangent between the outer periphery of the roll R and the nip rollers 24 is directed roughly toward the feed port 27 when the feed cover 301 is at the closed position. The sheet S can thus be fed from the roll R to the conveyance unit 9 regardless of whether the outer diameter of the roll R is the minimum or the maximum. Alternatively, without the feed cover 301, the nip roller units 24 can be configured to be retractable in attaching and detaching the roll R. The direction of rotation of the roll R and the direction of attachment and detachment of the roll R can be freely set.

<Forces Acting on Spool Gear>

Figure 10:
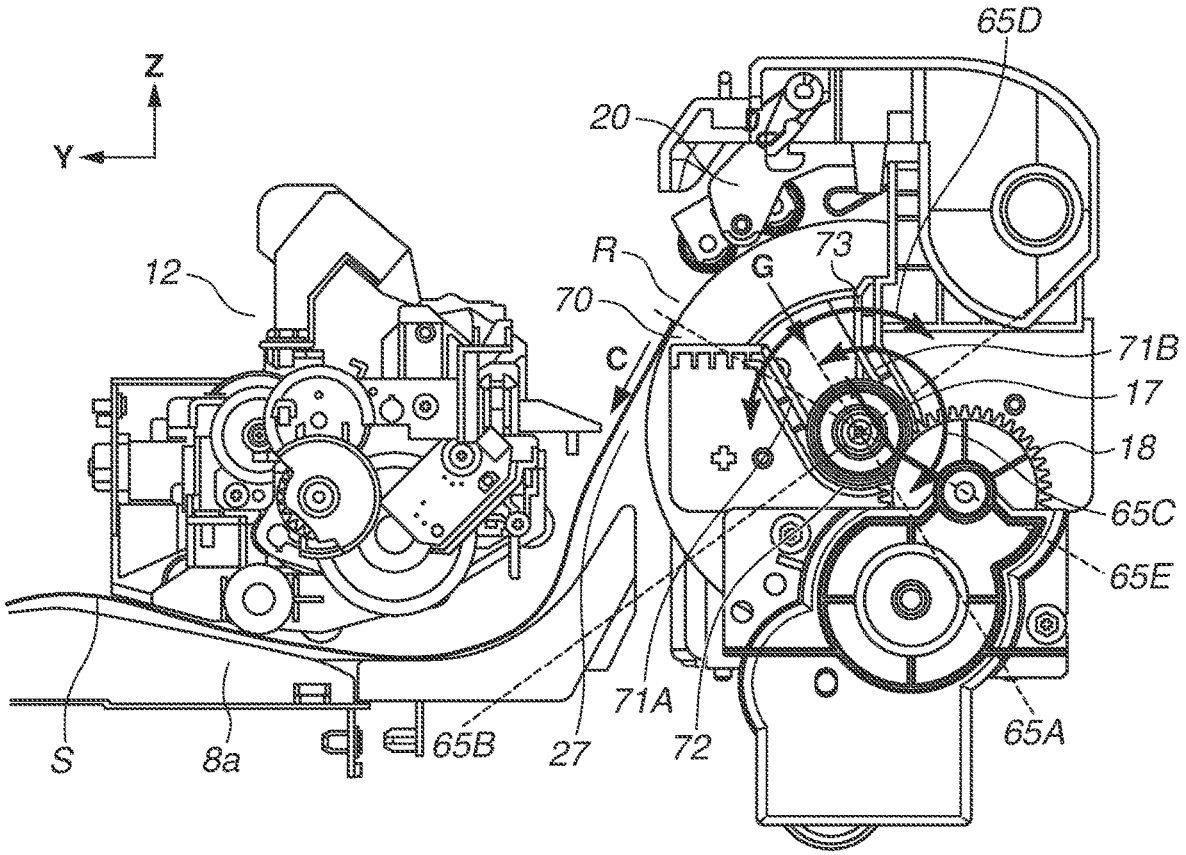
FIG. 10 is a sectional view illustrating the layout of a spool gear and components constituting the support unit.
Figure 11:
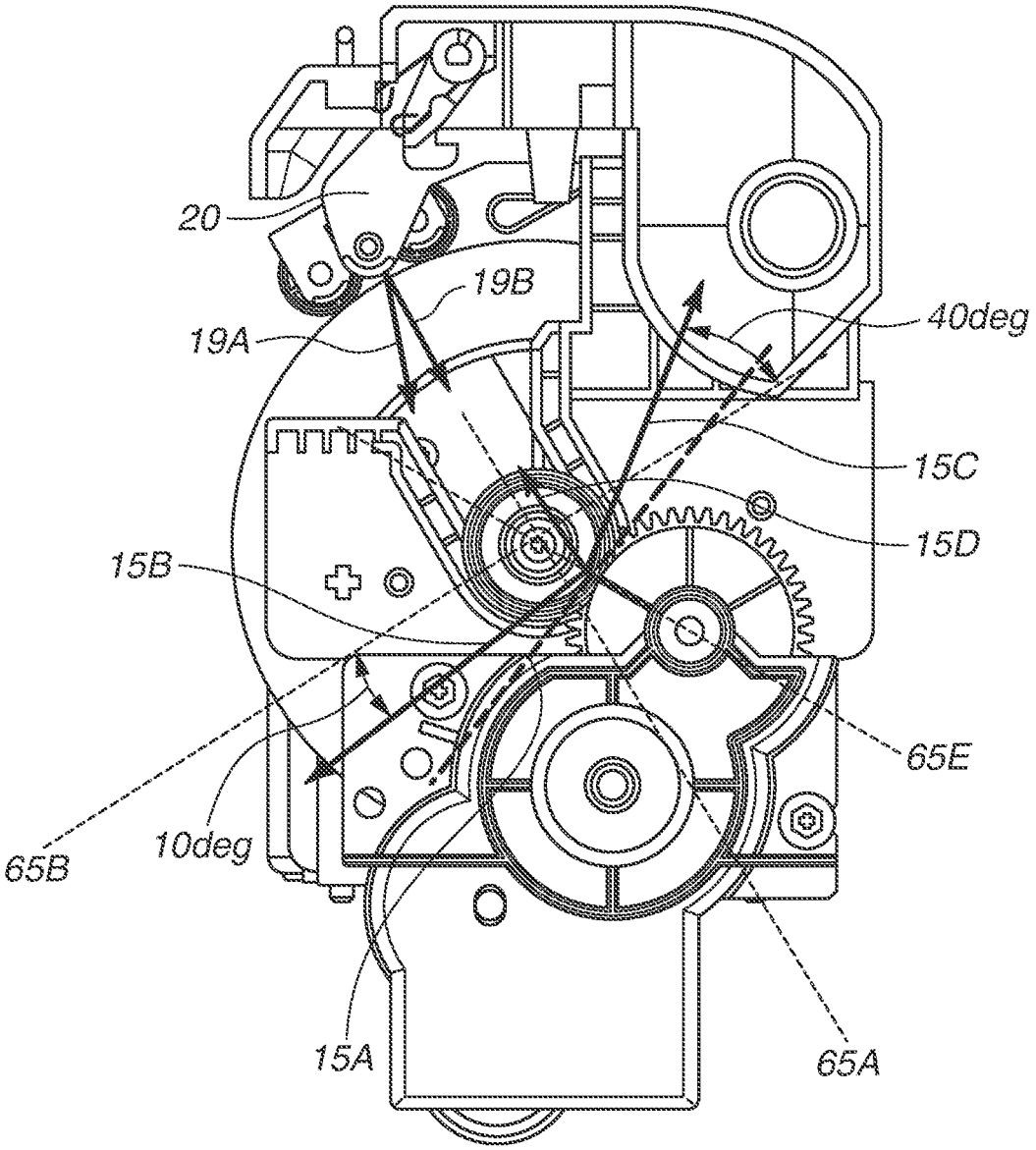
FIG. 11 is a diagram illustrating forces acting on the spool gear.
Figure 12A:
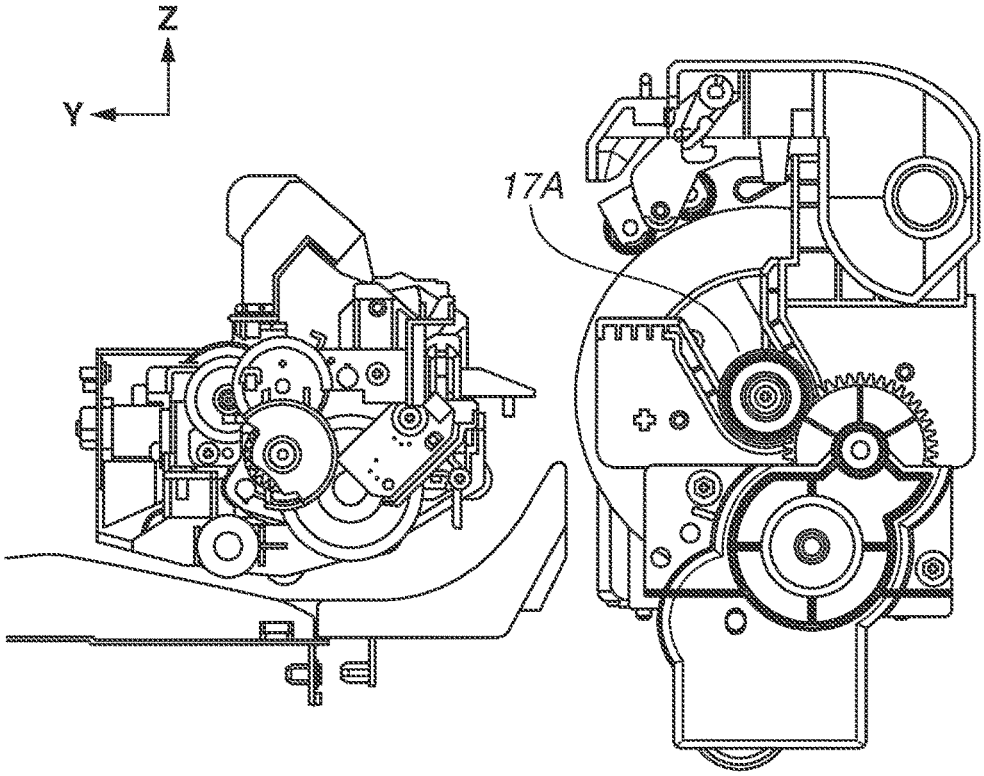
FIGS. 12A and 12B are diagrams for comparing cases with and without nip roller units.
Figure 12B:
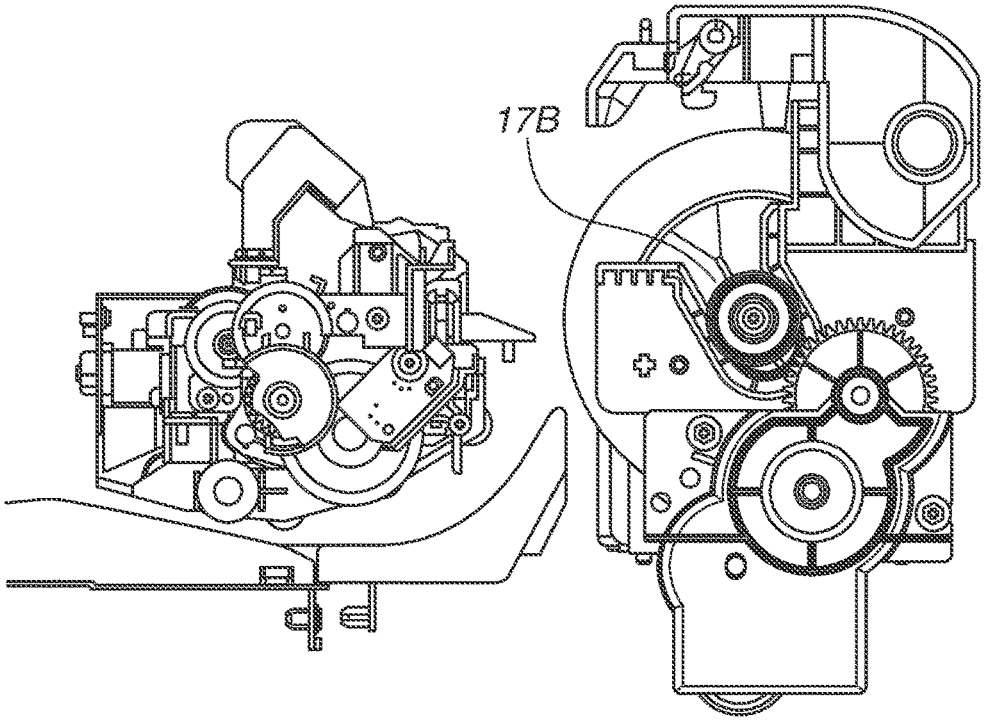

In the present exemplary embodiment, the support portions 72 are configured so that the roll R driven to rotate is less likely to come off. Forces acting on the spool gear 17 will be described with reference to FIGS. 10 to 12. FIG. 10 is a diagram illustrating the layout of the spool gear 17 and the components constituting the support unit 25. FIG. 11 is a diagram illustrating the forces acting on the spool gear 17.

FIG. 12 is a diagram for comparing the cases with and without the nip roller units 20.

The guide portions 71 of the support units 25 is sloped and thus guide the roll R from the setting tables 70 in the direction of gravity and the guide direction G opposite to the conveyance direction C. In loading the roll R on the support units 25, the roll R is guided along the lower guide portions 71A. The guide paths of the guide portions 71A extend straight to the support portions 72 without bending in the middle. As illustrated in FIG. 10, a straight line that passes through the center of the roll R loaded on the support portion 72 and is parallel to the guide direction G of the guide portions 71 will be referred to as a line 65A. A line that passes through the center of the roll R loaded on the support portion 72 and is orthogonal to the guide direction G of the guide portions 71 will be referred to as a line 65B. The line 65A is at an angle of 30° from the vertical direction to downstream in the conveyance direction C. The rotation center of the drive gear 18 engaged with the spool gear 17 is located in an area 65C upstream of the line 65A in the conveyance direction C.

In such a configuration, if, in FIG. 11, the rotation direction of the drive gear 18 is counterclockwise, the spool gear 17 does not receive a component force in the direction away from the support portion 72. As illustrated in FIG. 11, the tangent to both the reference circles of the drive gear 18 and the spool gear 17 at the point of contact between the reference circles will be referred to as a tangent 15A. If the drive gear 18 rotates counterclockwise, the spool gear 17 receives a force in a direction 15B. The angle formed between the direction 15B and the tangent 15A is the same as the pressure angle of the gears, which is 20°. A straight line connecting the centers of the spool gear 17 and the drive gear 18 will be referred to as a line 65E. The angle formed between the lines 65A and 65E is 30°. The direction of the force that the spool gear 17 receives from the drive gear 18 is thus 10° downward from the line 65B, and the spool gear 17 is pressed against the support portion 72. If the rotation direction of the drive gear 18 is counterclockwise, the spool gear 17 is thus less likely to be separated from the support portion 72.

By contrast, if, in FIG. 11, the rotation direction of the drive gear 18 is clockwise, the spool gear 17 receives a component force in the direction away from the support portion 72. The drive gear 18 rotates clockwise while the sheet S is fed to the conveyance roller 9*a*. Here, the force that the spool gear 17 receives from the drive gear 18 will be referred to as a net force 15C. The angle formed between the net force 15C and the tangent 15A is the same as the pressure angle of the gears, i.e., 20°. The line 65A is at an angle of 30° counterclockwise from the vertical direction. The line 65E is at an angle 30° further counterclockwise from the line 65A. The direction of the force that the spool gear 17 receives from the drive gear 18 is thus 40° upward from the line 65B, and the spool gear 17 receives a force in a direction away from the support portion 72.

The component force of the net force 15C in the direction opposite to the guide direction G will be referred to as a component force 15D. The component force 15D is a force in the direction in which the spool gear 17 is separated from the support portion 72. Now, the force that the roll R receives from the nip rollers 24 will be referred to as a net force 19A. The component force of the net force 19A in the guide direction G will be referred to as a component force 19B. The component force 19B by which the nip roller units 20 press the roll R in the guide direction G is set to be greater than the component force 15D in the direction in which the spool gear 17 is separated from the support portion 72. The roll R therefore will not be separated from the support portion 72. The cases with and without the nip roller units 20 will now be compared with reference to FIGS. 12A and 12B. With the nip roller units 20 (FIG. 12A), the pressing force from the nip roller units 20 prevents the spool gear 17A from being separated from the support portion 72. By contrast, without the nip roller units 20 (FIG. 12B), a spool gear 17B can be separated from the support portion 72 since the spool gear 17B receives the component force in the direction away from the support portion 72. In such a state, the spool gear 17B is disengaged from the drive gear 18. The sheet S can therefore be stably fed from the roll R using the nip roller units 20.

<Loading of Roll>

A method by which the user loads the roll R on the roll setting unit 28 will be described. The user attaches the spool units 26 by inserting the insertion portions 39 into both ends of the roll R. To load the roll R, the user then manually rotates the feed cover 301 to the open position. Here, the recording apparatus 1 is in a standby state where recording is not performed, or a shutdown state with the power off. The user then places the roll R to which the spool units 26 are attached on the setting tables 70. The user releases his/her grip on the spool units 26, and the spool shafts 38 descend the slopes of the setting tables 70 by gravity. The spool shafts 38 are guided by the guide portions 71 from upstream in the guide direction G to reach the support portions 72 having the arc-shaped surfaces. As a result, the spool shafts 38 are supported by the support portions 72. Here, the spool gear 17 is engaged with the drive gear 18 of the support unit 25 and connected to the feed motor 8*b*. Finally, the user rotates the feed cover 301 to the closed position, whereby the loading of the roll R is completed. Note that the setting tables 70 may be horizontal ones. In such a case, the user guides the roll R from the setting tables 70 to the guide portions 71. Either one of the setting tables 70 of the support units 25 may be horizontal while the other is sloped.

Next, a method by which the user unloads the roll R will be described. The user rotates the feed cover 301 at the closed position to the open position. The user can then detach the roll R from the support units 25 by pulling the roll R to the front side of the recording apparatus 1 in the direction opposite to the guide direction G. The user then rotates the feed cover 301 to the closed position, whereby the unloading of the roll R is completed.

Figure 13A:
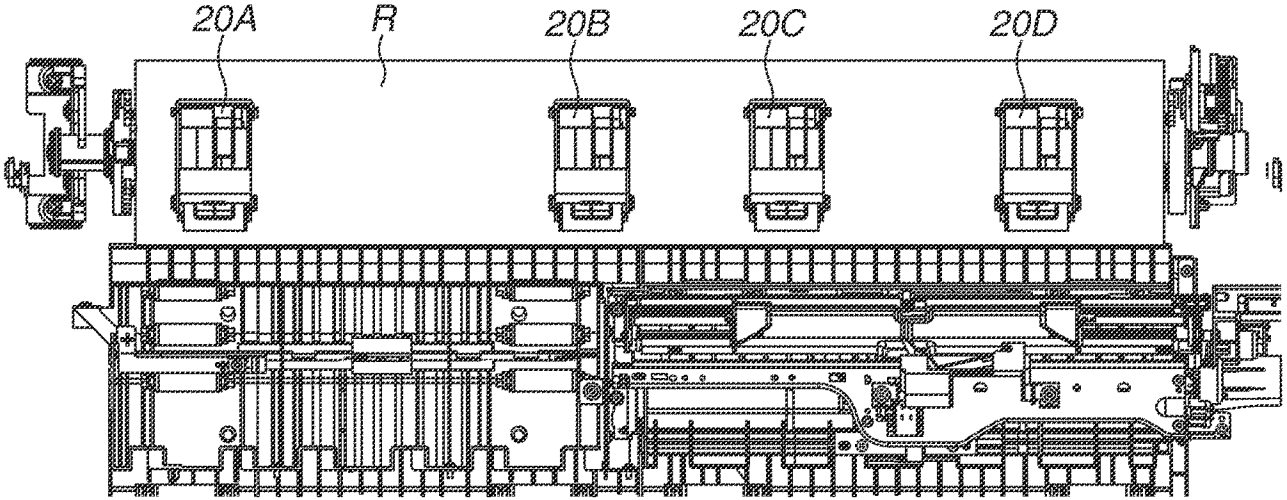
FIGS. 13A and 13B are top views illustrating a relationship between the nip roller units and a roll.
Figure 13B:
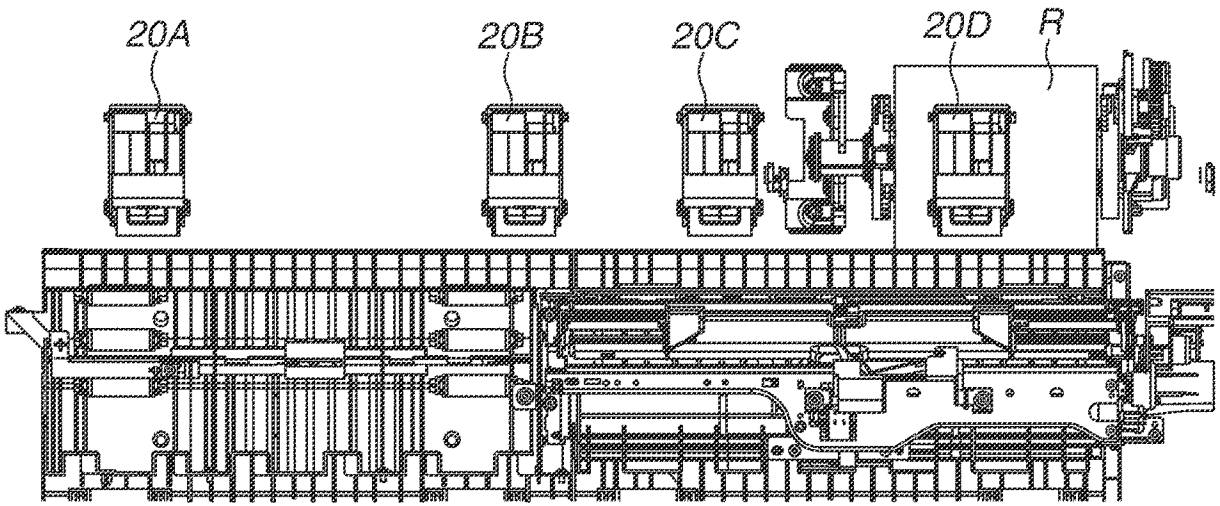

A relationship between the nip roller units 20 and the roll R in cases where rolls R of different widths are loaded on the recording apparatus 1 will be described with reference to FIGS. 13A and 13B. FIGS. 13A and 13B are top views illustrating the relationship between the nip roller units 20 and the rolls R. The plurality of nip roller units 20 is arranged in the X direction in the order of 20A, 20B, 20C, and 20D. FIG. 13A illustrates a state where a roll R having the maximum specification width is loaded. Here, all the nip roller units 20 press the roll R. FIG. 13B illustrates a state where a roll R having the minimum specification width is loaded. Here, only the nip roller unit 20D presses the roll R. The nip roller units 20 are thus disposed so that at least one nip roller unit 20 presses the roll R even when the roll R has the minimum specification width.

Figure 14A:
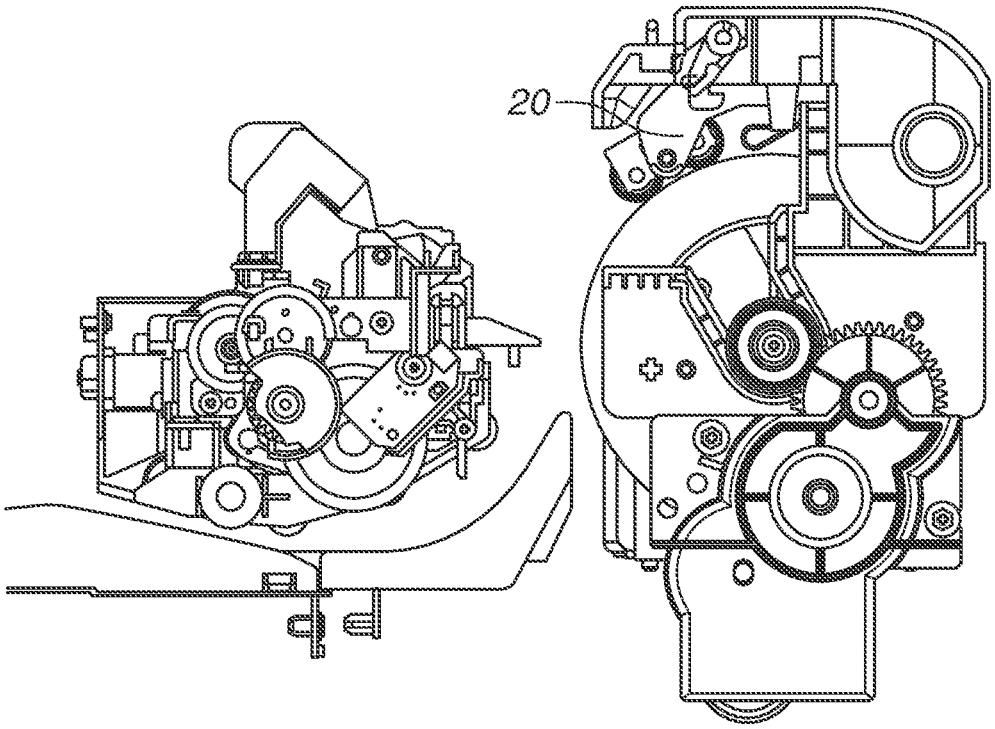
FIGS. 14A and 14B are diagrams for describing a state where the outer diameter of the roll has changed.
Figure 14B:
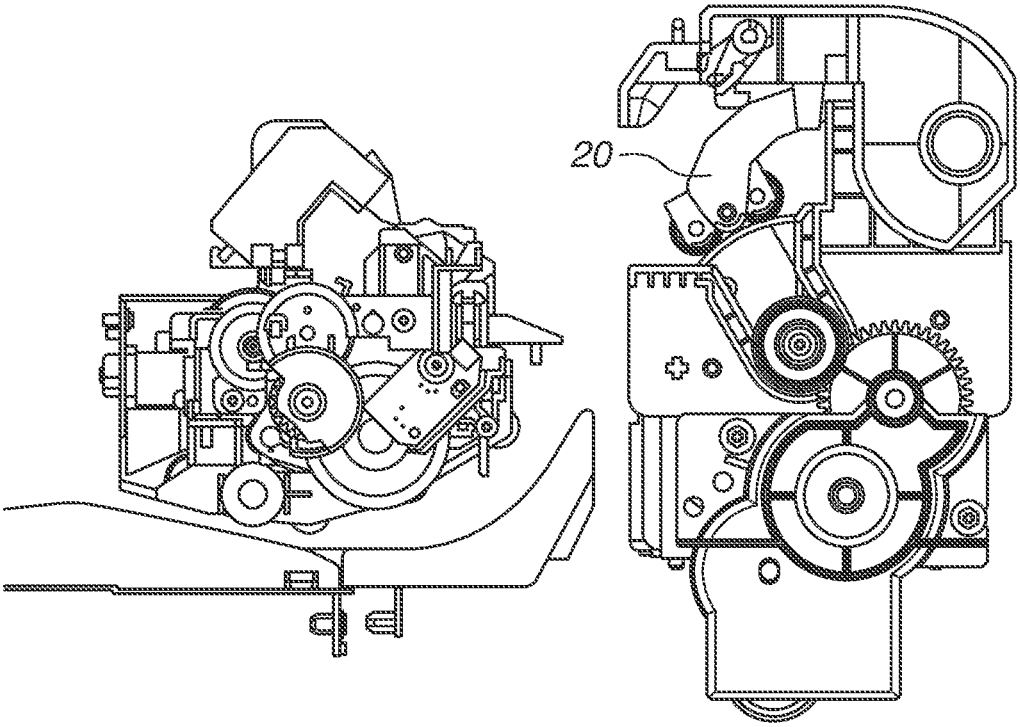

FIGS. 14A and 14B are diagrams for describing a state where the outer diameter of the roll R has changed. FIG. 14A illustrates a state where the roll R having the maximum loadable outer diameter is loaded on the recording apparatus 1. FIG. 14B illustrates a state where the outer diameter of the roll R has decreased due to the consumption of the roll R. If the outer diameter of the roll R changes, the nip roller units 20 are pressed against the roll R by spring biasing. In the state where only one nip roller unit 20 presses the roll R and the outer diameter of the roll R has decreased to the minimum, the force by which the nip roller units 20 press the roll R is the smallest. The spring biasing force is set so that the roll R will not be separated from the support portions 72 even under such a pressing force.

The conventional movement blocking unit is configured to rotate in an interlocking manner with the cover in loading and unloading the roll. Such a sheet feeing apparatus therefore desirably includes a space where the movement blocking unit is retracted. This complicates the configuration of the movement blocking unit. The configuration of the roll setting unit according to the present exemplary embodiment does not need the movement blocking unit and thus enables a reduction in cost and size. A sheet feeding apparatus capable of feeding a sheet from a roll with a simple configuration can thus be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-211159, filed Dec. 24, 2021, which is hereby incorporated by reference herein in its entirety.

What is claimed is:

1. A sheet feeding apparatus comprising:

a support portion including arc shaped surface and configured to rotatably support a roll of sheet;

a first gear disposed on a spool shaft to be inserted into the roll to support the roll with the support portion;

a guide portion including a slope portion and configured to, in loading the roll, guide the spool shaft in a guide direction from above the support portion to the support portion;

a second gear disposed on the support portion and configured to be engaged with the first gear;

a motor configured to rotate the second gear; and a roller configured to contact an outer periphery of the roll supported by the support portion, wherein the roller is configured to contact the roll from upstream in the guide direction, and, in feeding the sheet, the sheet is fed from the roll supported by the support portion.

2. The sheet feeding apparatus according to claim 1, further comprising a conveyance unit configured to convey the sheet fed from the roll in a conveyance direction, wherein the guide portion has an opening on a conveyance unit side with respect to a vertical direction from a center of the roll supported by the support portion.

3. The sheet feeding apparatus according to claim 1, further comprising a cover configured to be closed to a closed position to cover the roll supported by the support portion and opened to an open position to expose the roll, wherein the roller is held on the cover, and configured to bias the roll supported by the support portion using a biasing unit disposed on the cover.

4. The sheet feeding apparatus according to claim 3, further comprising a reading device configured to read a document, wherein the cover and the reading device are arranged in a direction in which the sheet is fed.

5. The sheet feeding apparatus according to claim 1, wherein a guide path from an opening of the guide portion to the support portion is straight.

6. The sheet feeding apparatus according to claim 1, wherein the roller is configured to move depending on an outer diameter of the roll.

7. The sheet feeding apparatus according to claim 1, wherein a first component force in the guide direction by which the roller presses the roll is greater than a second component force in a direction opposite to the guide direction that the spool shaft receives from driving by the motor.

8. The sheet feeding apparatus according to claim 1, wherein a plurality of rollers is arranged in a width direction of the roll.

9. A recording apparatus comprising:

a support portion including arc shaped surface and configured to rotatably support a roll of sheet;

a first gear disposed on a spool shaft to be inserted into the roll to support the roll with the support portion;

a recording unit configured to record an image on the sheet fed from the roll supported by the support portion;

a guide portion including a slope portion and configured to, in loading the roll, guide the spool shaft in a guide direction from above the support portion to the support portion; and a second gear disposed on the support portion and configured to be engaged with the first gear;

a motor configured to rotate the second gear;

a roller configured to contact an outer periphery of the roll supported by the support portion, wherein the roller is configured to contact the roll from upstream in the guide direction.

10. The recording apparatus according to claim 9, further comprising a conveyance unit configured to convey the sheet fed from the roll in a conveyance direction, wherein the guide portion has an opening on a conveyance unit side with respect to a vertical direction from a center of the roll supported by the support portion.

11. The recording apparatus according to claim 9, further comprising a cover configured to be closed to a closed position to cover the roll supported by the support portion and opened to an open position to expose the roll, wherein the roller is held on the cover, and configured to bias the roll supported by the support portion using a biasing unit disposed on the cover.

12. The recording apparatus according to claim 11, further comprising a reading device configured to read a document, wherein the cover and the reading device are arranged in a direction in which the sheet is fed.

13. The recording apparatus according to claim 9, wherein a guide path from an opening of the guide portion to the support portion is straight.

14. The recording apparatus according to claim 9, wherein the roller is configured to move depending on an outer diameter of the roll.

* * * * *